US006015946A

United States Patent [19]

Yamaryo

[11] Patent Number: 6,015,946

[45] Date of Patent: Jan. 18, 2000

[54] WOODWIND INSTRUMENT HAVING KEY CUPS REGULATED IN WEIGHT FOR GIVING APPROPRIATE TOUCH TO PLAYER

[75] Inventor: Shigeru Yamaryo, Shizuoka, Japan

[73] Assignee: Yamaha Corporation, Japan

[21] Appl. No.: 09/097,967

[22] Filed: Jun. 16, 1998

[30] Foreign Application Priority Data

Jun. 16, 1997 [JP] Japan ..... 9-158435

[51] Int. Cl.[7] ..... G10D 7/00

[52] U.S. Cl. ..... 84/380 R; 84/385 P

[58] Field of Search ..... 84/380 R, 385 P

[56] References Cited

U.S. PATENT DOCUMENTS 1,638,808 8/1927 Gulick et al. .

4,798,122 1/1989 Gisler et al. ..... 84/395 P 4,967,632 11/1990 Etheredge, III et al. ..... 84/385 P 5,183,954 2/1993 Wasser ..... 84/385 P

*Primary Examiner*—Jeffrey Donels

*Attorney, Agent, or Firm*—Ostrolenk, Faber, Gerb & Soffen, LLP

[57] ABSTRACT

A woodwind instrument changes the pitch of sound by selectively closing and opening tone holes by means of a key mechanism, and a player manipulates the key mechanism so as to bring tampons respectively received in key cups into contact with edges defining the tone holes; when a manufacturer shapes the key cups, he forms grooves in the bottom portions of the key cups for regulating the key cup to appropriate weight, and the player feels the key-touch light and comfortable.

6 Claims, 2 Drawing Sheets

WOODWIND INSTRUMENT HAVING KEY CUPS REGULATED IN WEIGHT FOR GIVING APPROPRIATE TOUCH TO PLAYER

FIELD OF THE INVENTION

This invention relates to a woodwind instrument and, more particularly, to a woodwind instrument having key cups regulated in weight for giving appropriate touch to a player.

DESCRIPTION OF THE RELATED ART

An oboe, a clarinet and a saxophone are members of the woodwind instrument. The woodwind instrument has a tube, and tone holes are formed in the tube at intervals. Keys are attached to the outer surface of the tube, and a player manipulates the keys so as to selectively open and close the tone holes. A vibrating air column is formed in the tube, and the keys shorten and lengthen the vibrating air column for changing the pitch of sound. Thus, the keys are important components of the woodwind instrument.

FIGS. 1 and 2 illustrate a part of the woodwind instrument The woodwind instrument 1 comprises a tube 2 and a key mechanism 3. Openings are formed in the tube 2 at intervals, and short tubes 3 are aligned with the openings, respectively. The short tubes 3 are fixed to the tube 2, and provide tone holes 4, respectively.

The key mechanism 3 includes posts 5 projecting from the tube 2, connecting rods 6 turnably supported by the posts 5, arms 7 fixed to the connecting rods 6, key cups 8 fixed to the arms 7 and tampons 9 respectively received in the key cups 8. Though not shown in FIGS. 1 and 2, levers are further connected to the connecting rods 6, and springs urges the connecting rods 6 to turn in the direction to open the tone holes 4. While a player is playing a tune on the woodwind instrument, he manipulates the levers to selectively open and close the tone holes 4, and the woodwind instrument changes the pitch of sound along the tune.

The key cup 3 forms a recess, and a stem 10 is brazed to the bottom surface 3*a* of the key cup 3. A female screw is formed in the stem 10. The tampon 9 is placed in the recess, and a plate 11 is pressed against the tampon 9. A bolt 12 is screwed into the female screw, and the plate 11 is fixed to the stem 10. The tampon 9 is sandwiched between the bottom surface 3*a* of the key cup 3 and the plate 11.

The tampon 9 is expected to be air-tight, durable and conformable to the edge of the short tube 3, and is implemented by a lamination of a core member and a skin member. The core member is formed from an air permeable sheet, and the skin member is formed from an airtight sheet. A lamination of compressed felt sheet and paper sheet is available for the core member, and the airtight sheet is formed of bladder or skin of a sheep or a calf. The bladder is skin of internal organs of a sheep or a goat.

The key cups 3 are shaped through a drawing, and are equal in weight. The key cups 3 are attached to the arms without any regulation of weight. In other words, the manufacturer does not pay any attention to the key touch. The key-touch may be light enough to feel the manipulation comfortable for a player. However, some players feel the lever too heavy. This is the first problem inherent in the prior art key mechanism 3.

Another problem inherent in the prior art key mechanism is conformability of the tampon 9 so that the air is leaked from the tube 1. The first reason is poor flatness of the bottom surface 3*a* due to the drawing, and the tampon 9 is oblique to the edge of the short tube 3. The second reason is the stem 10 liable to be obliquely brazed to the key cup 3. The oblique stem 10 makes the plate 11 to unevely press the tampon against the bottom surface 3*a*, and, accordingly, deteriorates the conformability of the tampon 9.

There is a key cup integral with a stem as shown in FIG. 3. The key cup portion 20 and the stem portion 21 are integral with each other, and a tampon 22 is received in the recess formed in the key cup portion 20. A stopper 23 is attached to the stem portion 21, and presses the tampon 22 against the bottom surface 20*a* of the key cup portion 20. The key cup portion 20 and the stem portion 21 are shaped through the drawing. For this reason, although the perpendicularity between the bottom surface 20*a* and the stem portion 21 may be slightly improved, the flatness of the bottom surface 20*a* is still poor, and the air is still leaked from the tone hole.

SUMMARY OF THE INVENTION

It is therefore an important object of the present invention to provide a key mechanism of a woodwind instrument, which gives comfortable key touch to a player and prevents the woodwind instrument from leakage air.

To accomplish the object, the present invention proposes to form lathe a key cup for forming a groove regulating the weight thereof.

In accordance with one aspect of the present invention, there is provided a woodwind instrument comprising a tube body having at least one tone hole, and a key mechanism attached to the tube body and including at least one tampon movable between a first position for opening the tone hole and a second position for closing the tone hole and a key cup having a wall portion and a bottom portion defining a recess together with the wall portion for receiving the tampon, and the bottom portion has a groove open to the recess for decreasing the weight of the key cup.

The key cup may be machined by using a lathe.

BRIEF DESCRIPTION OF THE DRAWINGS

The features and advantages of the woodwind instrument will be more clearly understood from the following description taken in conjunction with the accompanying drawings in which.

DESCRIPTION OF THE PREFERRED EMBODIMENTS

First Embodiment

Figure 1:
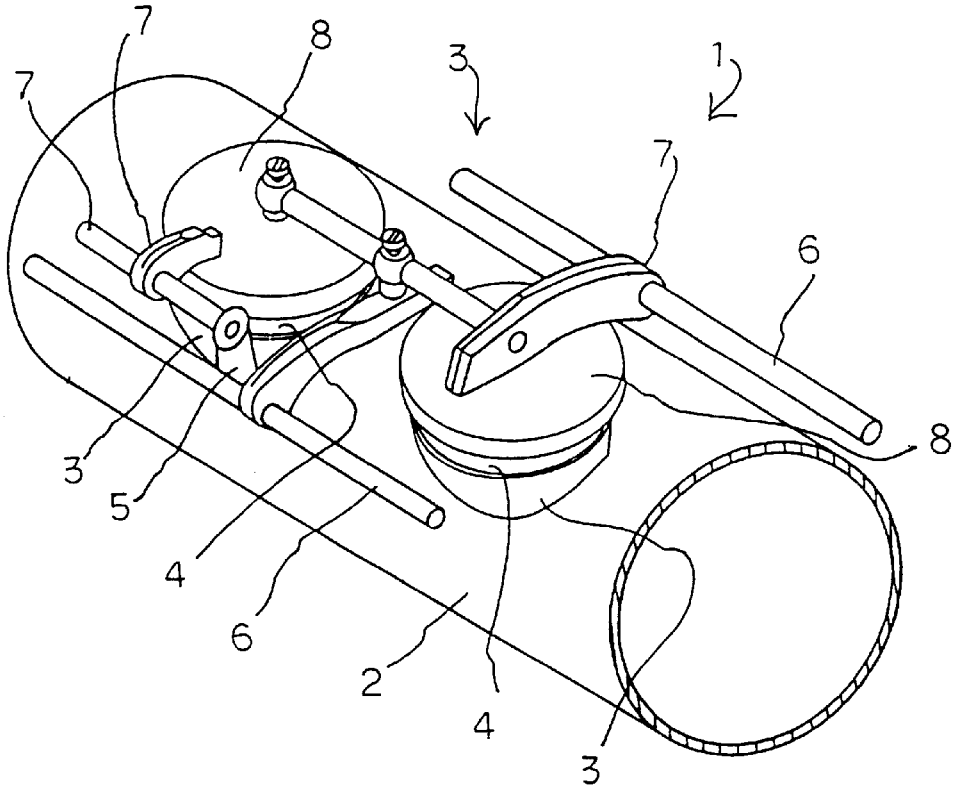
Fig. 1 PRIOR ART
FIG. 1 is a perspective view showing the part of the woodwind instrument.
Figure 2:
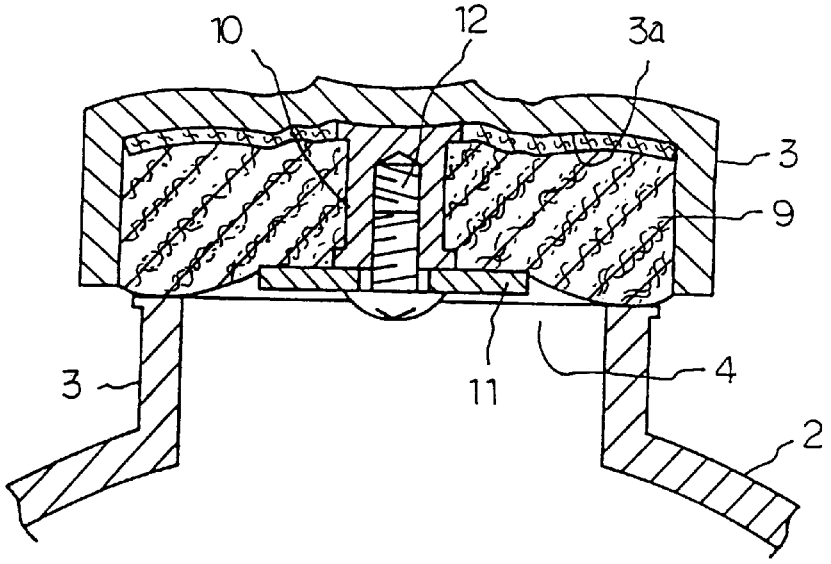
Fig. 2 PRIOR ART
FIG. 2 is a cross sectional view showing the tampon received in the prior art key cup.
Figure 3:
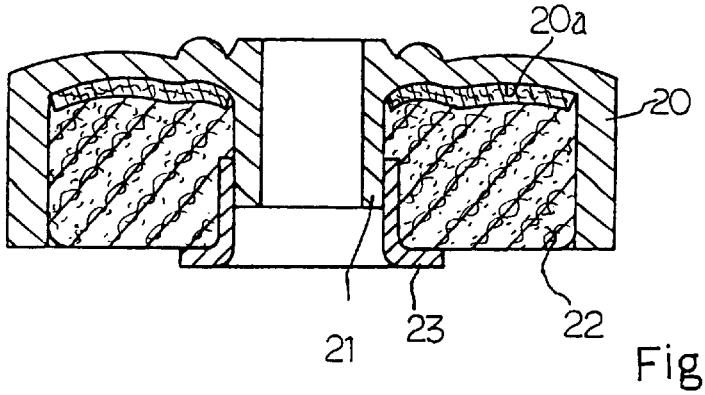
Fig. 3 PRIOR ART
FIG. 3 is a cross sectional view showing the prior art key cup integral with the stem.
Figure 4:
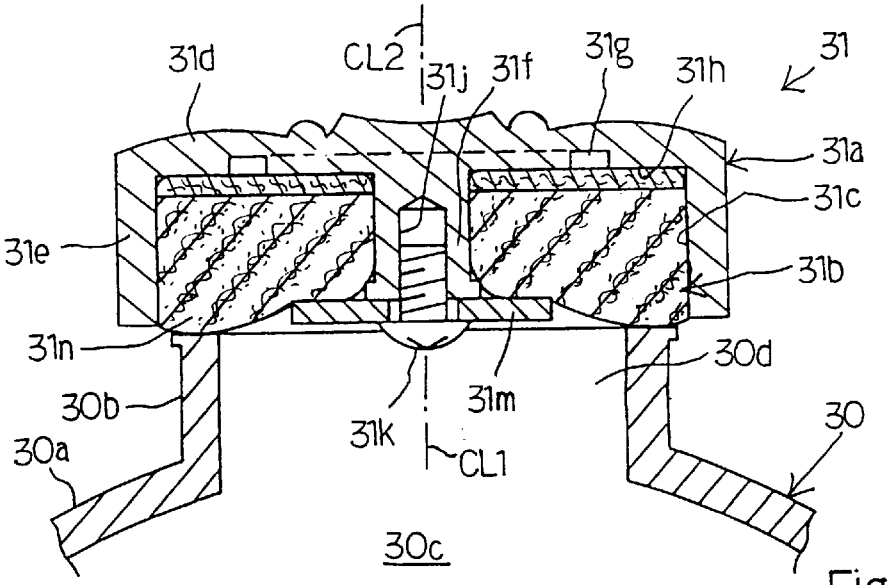
FIG. 4 is a cross sectional view showing a tampon received in a key cup forming a part of a key mechanism according to the present invention.

Referring to FIG. 4 of the drawings, a woodwind instrument embodying the present invention largely comprises a tubular body 30 and a key mechanism 31. The tubular body 30 includes a long tube 30*a* and short tubes 30*b*. The long tube 30*a* forms an inner space 30*c*, and has a center line perpendicular to the paper where FIG. 4 is drawn. Openings are formed in the long tube 30, and are spaced from one another along the center line. The short tubes 30*b* are aligned with the openings, respectively, and are brazed to the long tube 30*a*, respectively. The short tubes 30*b* define tone holes 30*d*, respectively, and the tone holes 30*d* connect the inner space 30*c* to the atmosphere.

The key mechanism 30 is similar to the key mechanism 3 except for key cups 31*a*, and the tampons 31*b* are received in the key cups 31*a*, respectively. The key cup 31*a* has a ring-shaped recess 31*c*, and a manufacturer forms the ring-shaped recess 31*c* through a lathe work. For this reason, the recess 31*c* is divided into a bottom portion 31*d*, a wall portion 31*e* and a stem portion 31*f*.

The bottom portion 31*d* has a generally disk configuration, and the wall portion 31*e* projects from the periphery of the bottom portion 31*d*. The stem portion 31*f* projects from a central area of the bottom portion 31*d*, and has a center line CL1 aligned with the center line of the bottom portion. Accordingly, the ring-shaped recess 31*c* is coaxial to the stem portion 31*f* and the bottom portion 31*d*. A ring-shaped groove 31*g* is formed in the bottom portion 31*d* through the lathe work, and is also coaxial to the stem portion 31*f*. The width and the depth of the ring-shaped groove 31*g* are designed such that user feels the key-touch light and comfortable that is, the groove 31*g*, by removing material from the key cups 31*a*, decreases its weight. The amount of material removed is a function of the width and depth of the groove 31*g*. The groove 31*g* thereby regulates the weight of the key cup 31*a* . Thus, the key cup 31*a* is machined with a lathe, and achieves the following advantages.

First, the bottom surface 31*h* is flat and perpendicular to the center lines CL1/CL2. The tampon 31*b* is held in contact with the entire bottom surface 31*h*. Second, the ring-shaped groove 31*g* and the ring-shaped recess 31*c* are exactly coaxial to the stem portion 31*f* and the bottom portion 31*d*, and the center of gravity is located on the center lines CL1/CL2. The center of gravity on the center lines CL1/CL2 achieves good balance, and causes the tampon 31*b* to perfectly close the tone hole 30*d* .

A female screw 31*j* is formed along the stem portion 31*f*, and a bolt 31*m* fixes a plate 31*m* to the stem portion 31*f* . The plate 31*m* presses the tampon 31*b* against the flat bottom surface 31*h*, and the flat bottom surface 31*h* causes the tampon 31*b* to be in contact with the entire edge surface of the short tube 30*b*.

As will be appreciated from the foregoing description, the key cup 31*a* is machined with a lathe, and the flat bottom surface 31*h* becomes exactly perpendicular to the stem portion 31*h*. The plate 31*m* uniformly presses the tampon 31*b* against the bottom surface 31*h*, and a contact surface 31*n* of the tampon 31*b* is parallel to the bottom surface 31*h*. As a result, the tampon 31*b* is brought into contact with the edge of the short tube 30*b* alone the entire periphery, and the tampon 31*b* perfectly closes the tone hole 30*d*. This results in that the tampon 31*b* does not leak the air from the inner space 30*c*.

The center of gravity on the lines CL1/CL2 causes the key cup 31*a* to uniformly press the tampon 31*b* against the entire edge of the short tube 30*b*. Thus, the position of the center of gravity enhances the sealing capability of the tampon 31*b*.

Moreover, the manufacturer designs the ring-shaped groove 31*g* appropriate to a customer, and the player feels the key-touch light and comfortable.

Second Embodiment

Figure 5:
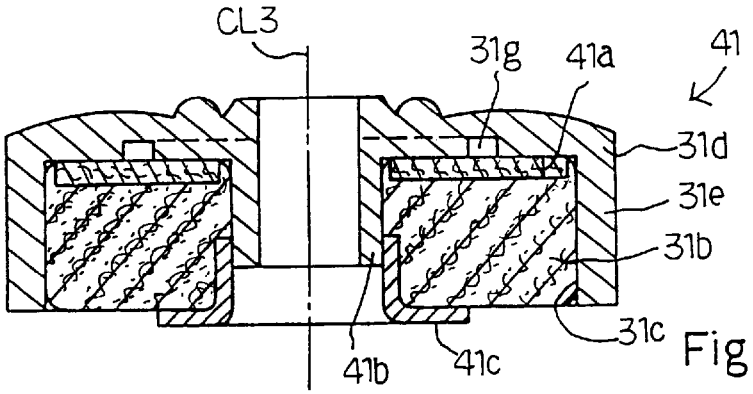
FIG. 5 is a cross sectional view showing a tampon received in a key cup forming a part of another key mechanism according to the present invention.

FIG. 5 illustrates another key cup 41 forming a part of the key mechanism embodying the present invention. The key cup 41 is similar to the key cup 31*a* except for a stem portion and a stopper. The key cup 41 is machined with a lathe, and achieves a flat bottom surface 41*a* and a stem portion 41*b* exactly perpendicular to the flat bottom surface 41*a*. The bottom portion, the wall portion, the groove and the tampon are similar to those of the first embodiment, and are labeled with the same references without detailed description.

Any female screw is formed in the stem portion 41*b*, and the stopper 41*c* prevents the tampon 31*b* from falling-off from the key cup 41. Namely, the stopper 41*c* is engaged with the stem portion 41*b* after insertion of the tampon 31*b* into the recess 31*c*, and presses the tampon 31*b* against the flat bottom surface 41*a* of the key cup 41.

The flat bottom surface 41*a* and the stem portion 41*b* are exactly perpendicular to each other, and the tampon 31*b* does not decline. The tampon 31*b* has a thickness unchanged along the periphery thereof, and is brought into contact with the entire periphery of the short tube (not shown in FIG. 5). The center of gravity is on the center line CL3, and the key cup 41 uniformly presses the tampon 31*b* against the entire edge of the short tube 30*b*. Thus, the tampon 31*b* perfectly closes the tone hole, and does not leak the air. The ring-shaped groove 31*g* also makes the key cup 41 light, and a player comfortably manipulates the lever during a performance.

Although particular embodiments of the present invention have been shown and described, it will be obvious to those skilled in the art that various changes and modifications may be made without departing from the spirit and scope of the present invention.

In this instance, the key cup 31*a*/41 is machined with a lathe . However, another machine tool is available for the key cup 31*a*/41 in so far as the machine tool achieves a good finish better than the drawing.

What is claimed is:

1. A woodwind instrument comprising a tube body having at least one tone hole, and a key mechanism attached to said tube body and including at least one tampon movable between a first position for opening said tone hole and second position for closing said tone hole and a key cup having a wall portion and a bottom portion defining a recess together with said wall portion for receiving said tampon, said bottom portion having a groove open to said recess for regulating the weight of said key cup.

2. The woodwind instrument as set forth in claim 1, in which said bottom portion has a flat bottom surface exposed to said recess and perpendicular to a center line of said key cup.

3. The woodwind instrument as set forth in claim 2, in which said key cup further has a stem portion having a center axis perpendicular to said flat bottom surface and a stopping member attached to said stem portion so as to prevent said tampon from falling-off from said recess.

4. The woodwind instrument as set forth in claim 3, in which said stopping member is implemented by a plate member bolted to said stem portion, and the plate member presses said tampon to said flat bottom surface.

5. The woodwind instrument as set forth in claim 3, in which said stopping member is implemented by a stopper having a hole, and said stem portion is snugly received in said hole so as to maintain said tampon between said stopper and said flat bottom surface.

6. The woodwind instrument as set forth in claim 2, in which said flat bottom surface is finished through a lathe work.

* * * * *